US008342084B2

(12) United States Patent
Flowers et al.

(10) Patent No.: US 8,342,084 B2
(45) Date of Patent: Jan. 1, 2013

(54) BOTTLE COMPACTOR

(75) Inventors: Amy Flowers, Charlotte, NC (US); Sumpter Smith, Rock Hill, SC (US)

(73) Assignee: Hyde Park Partners, Inc., Charlotte, NC (US)

( * ) Notice: Subject to any disclaimer, the term of this patent is extended or adjusted under 35 U.S.C. 154(b) by 281 days.

(21) Appl. No.: 12/782,778

(22) Filed: May 19, 2010

(65) Prior Publication Data

US 2011/0283899 A1 Nov. 24, 2011

(51) Int. Cl.
*B30B 13/00* (2006.01)
*B30B 1/04* (2006.01)
*B30B 11/04* (2006.01)

(52) U.S. Cl. ..... 100/35; 100/245; 100/293; 100/295; 100/902

(58) Field of Classification Search ..... 100/35, 100/218, 240, 245, 246, 280, 281, 283, 293, 100/295, 902
See application file for complete search history.

(56) References Cited

U.S. PATENT DOCUMENTS

| | | | | |
|---|---|---|---|---|
| 3,780,647 | A * | 12/1973 | Reimers | 100/232 |
| 4,088,072 | A | 5/1978 | Wittmeier | |
| 4,213,387 | A * | 7/1980 | McCaney et al. | 100/245 |
| 4,301,722 | A * | 11/1981 | Balbo et al. | 100/218 |
| 5,090,308 | A * | 2/1992 | Wang | 100/215 |
| 5,848,569 | A | 12/1998 | Maki et al. | |
| 6,481,346 | B1 * | 11/2002 | Miller | 100/269.13 |
| 6,571,696 | B1 * | 6/2003 | Adam | 100/214 |
| 6,598,522 | B2 * | 7/2003 | Yamaguchi | 100/42 |
| 7,066,084 | B2 | 6/2006 | Simon | |
| 7,185,585 | B2 | 3/2007 | Plumptre | |
| 2003/0034254 | A1 | 2/2003 | Ugon | |
| 2008/0115678 | A1 * | 5/2008 | Weinberg | 100/353 |

* cited by examiner

*Primary Examiner* — Jimmy T Nguyen
(74) *Attorney, Agent, or Firm* — Shumaker, Loop & Kendrick, LLP

(57) ABSTRACT

A compactor device is provided including a cylindrical housing having an elongate channel for receiving a bottle to be compacted therein and elongate guide slots, an end cap attached to a first end of the housing for seating the bottle and protecting the neck end of the bottle, a piston slidably disposed within the channel and having a forward ram for stuffing the bottle, and a lever for actuating linear movement of the piston within the channel, whether manually or automated.

16 Claims, 5 Drawing Sheets

BOTTLE COMPACTOR

TECHNICAL FIELD AND BACKGROUND OF THE INVENTION

1. Field of the Invention

The present invention relates generally to the field of compacting devices, and more particularly, to a device for compacting an empty plastic bottle that forces a bottom portion of the bottle into a protected neck portion to overcome the memory of the bottle and prevent it from expanding subsequent to compaction.

2. Background of the Invention

Compactors are well known in the art, both on residential and commercial scales, for reducing the volume of an empty article. With regard to polyethylene terephthalate (PET) articles in particular, such as plastic soda and water bottles, it is desirable to reduce the volume of these articles after use for baling and recycling purposes, as well as generally reducing trash volume. As PET articles tend to have a 'memory' that creates a rebound effect after compaction and during the baling process, plastic balers for these materials are often designed to accommodate higher pressures as well as overcome the memory factor to produce tight, dense bales that hold together well. These specially designed balers not only require special features that come at a price, but produce bales under high pressures that can come apart unexpectedly, causing injury and increasing handling costs.

Conventional compactors generally function to reduce the volume of an article by forcing the ends of the article toward one another. Plastic bottles, in particular, are engineered to be vertically compacted, i.e. with forces applied along their longitudinal axis. This is typically accomplished by securing the bottle within a fixture and actuating a moveable plate that forces one end of the bottle toward the other. While a state of compaction is achieved, the full amount of compaction applied is not typically able to be maintained, as the memory of the bottle causes it to partly return to its original shape. While the amount of rebound of the bottle may be slight and not critical when considering a single bottle, over time and when hundreds or thousands of bottles are baled together, such rebound forces produce bales under dangerously high pressures.

BRIEF SUMMARY OF THE INVENTION

Accordingly, there is a need to provide a device for better compacting plastic bottles and other articles.

It is an object of the present invention to provide a device that compacts a plastic bottle in such a way that the bottle is able to maintain substantially its full compaction.

It is another object of the present invention to provide a compacting device that essentially stuffs one end of the bottle into the other to overcome the memory of the bottle.

It is another object of the present invention to provide a compacting device that compacts an empty plastic bottle beyond a level of compaction previously obtainable.

It is another object of the present invention to provide a compacting device that allows for the rapid introduction, compaction, and removal of a bottle from the device.

It is another object of the present invention to provide a compacting device that may be manually operated or deployed within an automated system.

Therefore, there is provided a compactor device including a housing comprising an elongate cylindrical channel therein, a sidewall, a first opening through the sidewall for providing access to the channel, and diametrically opposed elongate guide slots defined through the sidewall and along a portion of a length of the housing. The compactor further includes an end cap located at a first end of the housing for capping the channel and seating a neck end of a bottle therein, the cap defining a cylindrical neck end protecting portion open to the channel and having a diameter less than a diameter of the channel, a piston slidably disposed within the channel and having a forward ram, the ram having a diameter less than the diameter of the channel, and a lever operably connected to the piston through the guide slots for actuating linear movement of the piston within the channel.

In accordance with another embodiment of the invention, the lever includes a handle pivotally connected about a second end of the housing and linkage pivotally connected at a first end to the handle and connected at a second end to the piston through the guide slots, and wherein rotational movement of the handle relative to the housing is translated into linear movement of the piston within the channel through the linkage.

In accordance with another embodiment of the invention, linear travel of the piston within the channel and relative to the end cap is determined by at least one of a length of the guide slots and travel of the lever relative to the housing.

In accordance with another embodiment of the invention, the compactor further includes a base for securing the compactor device to a work surface.

In accordance with another embodiment of the invention, the handle is pivotally connected to the base at about a second end of the housing.

In accordance with another embodiment of the invention, the housing is cylindrical and the channel has a diameter corresponding to an outer diameter of a plastic bottle to be compacted.

In accordance with another embodiment of the invention, the diameter of the forward ram of the piston about corresponds to the diameter of the cylindrical neck end protecting portion of the end cap.

In accordance with another embodiment of the invention, the first opening has a size about corresponding to that of an uncompacted bottle.

In accordance with another embodiment of the invention, the compactor further includes a second opening having a size corresponding to that of a compacted bottle and positioned on an underside of the housing to permit a compacted bottle to fall therethrough under gravity after compaction.

According to yet another embodiment of the invention, a method for compacting a plastic bottle is provided including providing a compactor device including a housing having an elongate cylindrical channel therein, a sidewall, a first opening through the sidewall for providing access to the channel, and diametrically opposed elongate guide slots defined through the sidewall and along a portion of a length of the housing, an end cap located at a first end of the housing for capping the channel and seating a neck end of a bottle therein, the cap defining a cylindrical neck end protecting portion open to the channel and having a diameter less than a diameter of the channel, a piston slidably disposed within the channel and having a forward ram, the ram having a diameter less than the diameter of the channel, and a lever operably connected to the piston through the guide slots for actuating linear movement of the piston within the channel. The method further comprises the steps of providing an uncompacted plastic bottle having an outer diameter about corresponding to the diameter of the channel, inserting the uncompacted bottle into the channel through the first opening and seating a neck end of the bottle against the end cap, and actuating the lever to move the piston toward the end cap to compact the bottle by stuffing a bottom portion bottle into the neck end of the bottle.

In accordance with another embodiment of the invention, the method further comprises the step of actuating the lever to move the piston toward a second end of the housing and apart from the bottle, and allowing the bottle to fall through an opening defined in an underside of the housing adjacent the cap end.

In accordance with another embodiment of the invention, the lever comprises a handle pivotally connected about a second end of the housing and linkage pivotally connected at a first end to the handle and connected at a second end to the piston through the guide slots, and wherein rotational movement of the handle relative to the housing is translated into linear movement of the piston within the channel through the linkage.

In accordance with another embodiment of the invention, the method further comprises the step of limiting linear travel of the piston within the channel and relative to the end cap through at least one of a length of the guide slots and limiting travel of the lever relative to the housing.

Additional features, aspects and advantages of the invention will be set forth in the detailed description which follows, and in part will be readily apparent to those skilled in the art from that description or recognized by practicing the invention as described herein.

BRIEF DESCRIPTION OF THE DRAWINGS

The present invention may be better understood by reference to the following description taken in conjunction with the accompanying drawing figures in which.

DETAILED DESCRIPTION OF THE INVENTION

Figure 1:
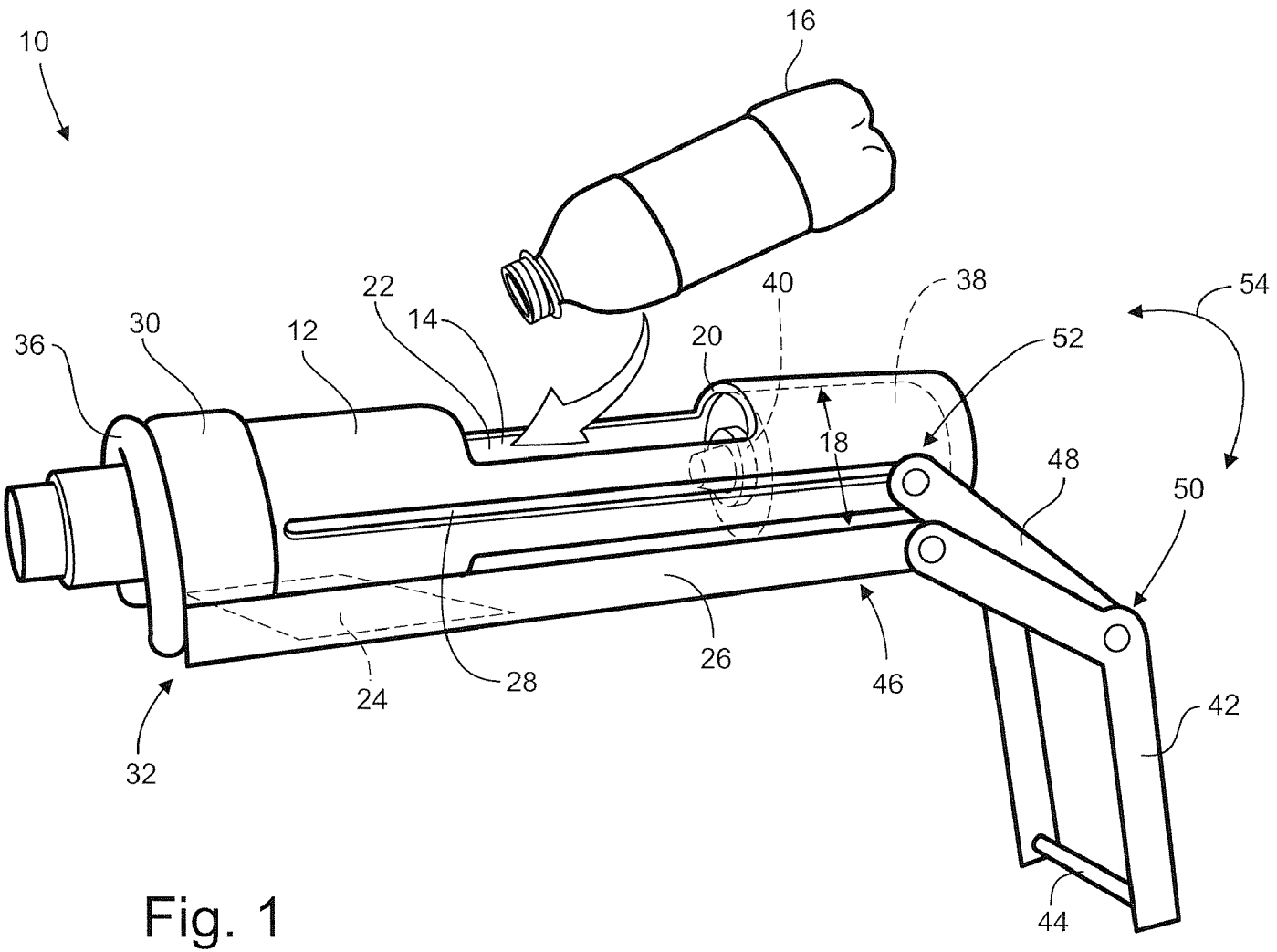
FIG. 1 is a perspective view of a bottle compactor in accordance with an embodiment of the present invention and showing a bottle being loaded therein.

Referring to the drawings wherein identical reference numerals denote the same elements throughout the various views, FIGS. 1-5 illustrate a bottle compactor generally at reference numeral 10 constructed in accordance with a preferred embodiment of the present invention. The compactor 10 includes a generally cylindrical housing 12 defining a cylindrical channel 14 therein for receiving a bottle 16, or other article, to be compacted. Suitable articles for compaction include, but are not limited to, PET soda and water bottles that are desired to be compacted by forces applied along their longitudinal axis, thus forcing one end of the bottle towards the other, and preferably forcing the bottom of the bottle toward and into the neck end of itself to overcome rebound from memory of the article. The cylindrical channel 14 defines an internal diameter 18 about corresponding to an external diameter of an article to be compacted. Sidewalls 20 of the housing 12 maintain the bottle during compaction in the proper alignment and prevent lateral expansion of the bottle during compaction. It should be appreciated that the housing 12 may have an alternative shape and appearance so long as it functions to maintain the bottle in proper alignment during compaction and substantially prevents lateral expansion thereof. The diameter 18 of the channel 14 may be sized to accommodate varying sizes of articles, such as single serving, 1 liter, and 2 liter bottles, among others.

The housing 12 defines at least a first opening 22 through the sidewall 20 for providing access to the channel for inserting an article to be compacted therethrough. As shown, the first opening 22 is positioned at the top of the housing 12 when in use to facilitate ease of loading of an article. In an optional embodiment, the housing 12 further defines a second opening 24 positioned on the underside of the housing when in use corresponding to the size of a compacted article. The second opening 24 allows the article to fall therethrough and out of the compactor 10 under the force of gravity or by another force. The second opening 24 may alternatively be defined through a base 26 of the compactor 10 as well. The first opening 22 defines a predetermined length and width that allows an uncompacted article to be inserted therethrough, such as at an angle to the housing 12 as shown. The length dimension of the second opening 24 is less than the length of the corresponding uncompacted article such that the article cannot fall therethrough before compaction. In an embodiment in which the second opening 24 is not present, a compacted article may be withdrawn through the first opening 22.

The housing 12 further defines diametrically opposed elongate guide slots 28 through the sidewall 20 and along a portion of a length of the housing 12. Although only the left side of the compactor 10 is shown in FIGS. 1-5, it should be understood that the right side of the compactor 10 is a mirror image of the left side, and thus includes the other guide slot diametrically opposing the slot shown. As shown, the guide slots 28 have a length less than that of the housing 12 for limiting travel and defining a guide path for guiding travel of linkage of a lever assembly, as described in detail below. The length of the guide slots 28 may thus be adjusted to control the length of travel of the lever assembly to control the amount of compaction.

The compactor 10 further includes an end cap 30 located on and capping a first end 32 of the housing 12. The end cap 30 defines a sidewall and internal clearance that is open to the channel 14, such that a properly inserted article to be compacted is seated within and against the end cap and is simultaneously maintained in both portions of the end cap 30 and the housing 12. The internal shape of the end cap 30 is configured to receive and seat the neck end of the article to be compacted. The end cap 30, and optionally a portion of the housing 12, thus protects a portion of the neck end of the article from compaction, allowing the opposing end, or 'bottom', to be 'stuffed' into the protected neck end portion. It should be understood that the internal shape of the end cap 30 preferably corresponds to the shape of the neck end of an article to be compacted. As shown, the end cap 30 may define various internal dimensions for limiting travel and receiving necked portions, thus providing a universal end cap for various article shapes. In a preferred embodiment, and as shown, the end cap 30 defines a cylindrical neck end protecting portion 34 open to the channel 14 and having a diameter less than the diameter 18 of the channel 14. As shown, the compactor 10 may be secured to a work surface through a base 26, and may optionally be clamped to a work surface, such as with at least one clamp 36 secured substantially around the end cap 30.

The compactor 10 further includes a piston 38 slidably disposed within the channel 14 and having a forward ram 40 located on a face of the piston 38 facing the first end 32. The piston 38 has a diameter about corresponding to that of the channel to provide linear travel with proper ram 40 alignment with the article. The ram 40 protrudes a predetermined distance beyond its respective face of the piston 38 and has a diameter less than that of the channel 14. The ram 40 is further preferably concentrically aligned within the channel 14. As the diameter of the channel 14 generally corresponds to that of the article, the lesser diameter of the ram 40 allows it to displace the bottom end of the article toward the neck end and into the neck end, effectively 'stuffing' the bottle into itself, in contrast to conventional compactors including a plate that merely urges one end of the article toward the other. Linear travel of the piston 38 within the channel 14 and relative to the end cap 30 is determined by at least one of the length of the guide slots 28 and travel of the lever relative to the housing 12. The length of protrusion of the ram 40 from its respective face of the piston 38, in combination with the linear travel of the piston 38, may be varied to determine the amount of compaction and stuffing of the article into its neck portion.

The compactor 10 further includes a lever 42 mechanically connected to the piston 38 through the guide slots 28 for actuating linear movement of the piston 38 within the channel 14. As shown, the lever 42 includes a gripping handle 44 pivotally connected about a second end 46 of the housing 12, and linkage 48 pivotally connected at a first end 50 to the lever 42 and pivotally connected at a second end 52 to the piston 38 through the guide slots 28. Rotational movement of the lever 42 relative to the housing 12, indicated by the double headed arrows 54, is translated into linear movement of the piston 38 within the channel 14 through the linkage 48. The linkage 48 is guided along the guide slots 28 that may have a predetermined length to provide a mechanical stop for travel of the linkage 48, and thus the lever 42.

In the embodiment shown, the compactor 10 is manually operated through the lever 42. In an alternative embodiment, the operation of the compactor 10 may be automated through control of the linear travel of the piston 38 within the channel 14, thus obviating the need for the lever assembly shown. In a specific alternative embodiment, piston travel may be achieved through a linear actuator, thus further obviating the need for the guide slots 28.

Figure 2:
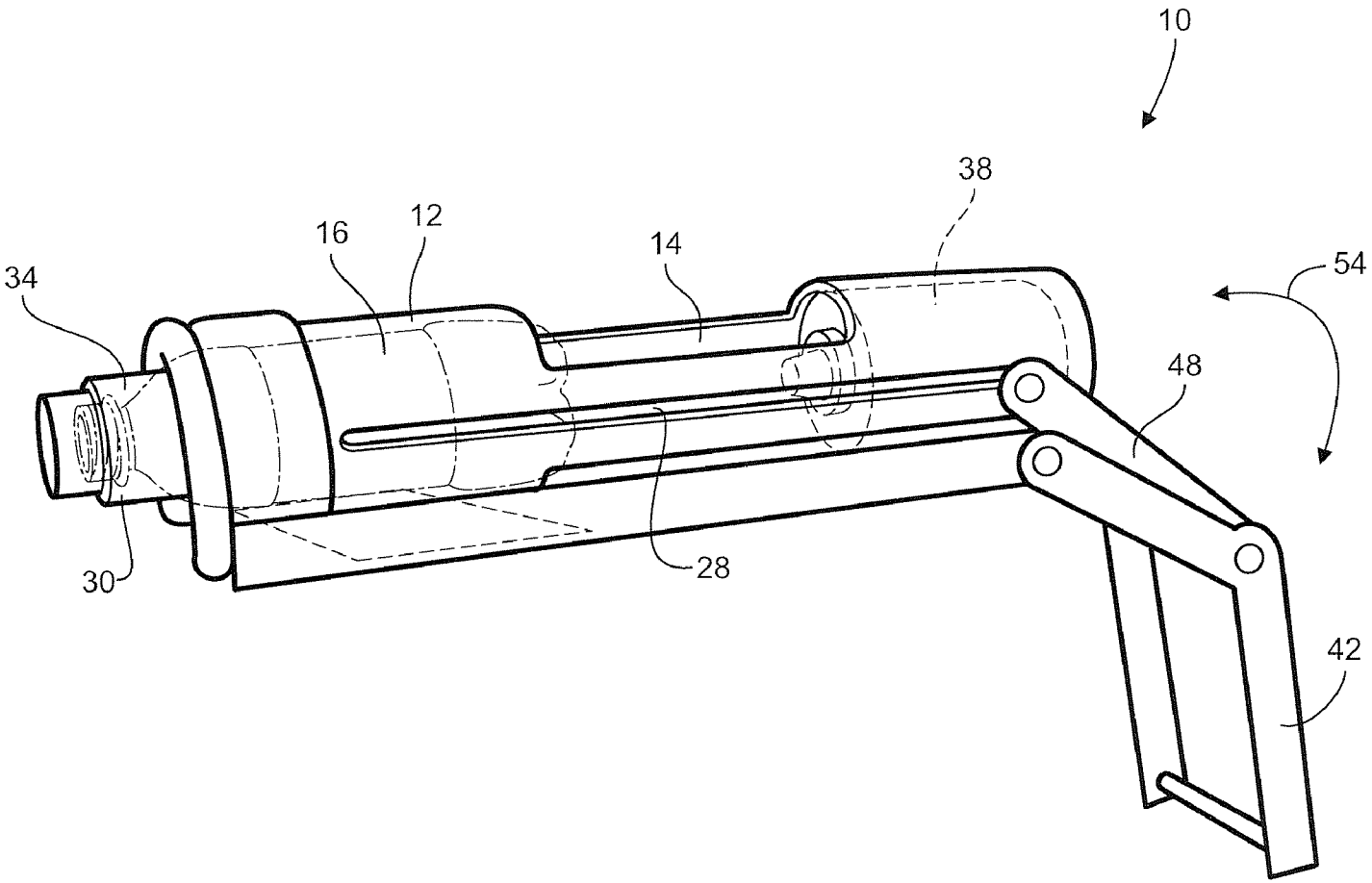
FIG. 2 is a perspective view of the compactor of FIG. 1 showing the bottle in the appropriate position within the compactor to be compacted.
Figure 3:
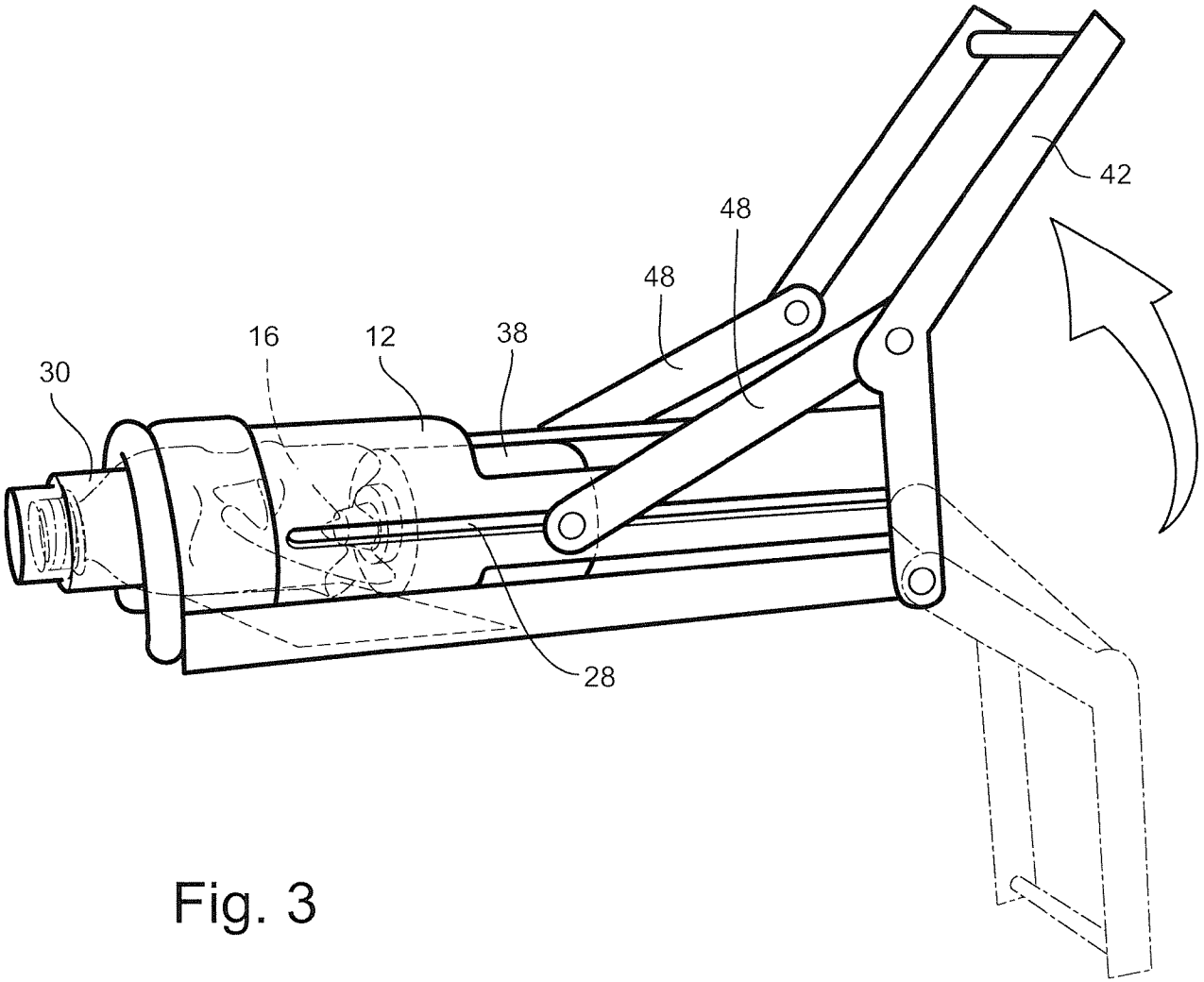
FIG. 3 is a perspective view of the compactor of FIG. 1 showing the lever partly actuated and the bottle partly compacted.
Figure 4:
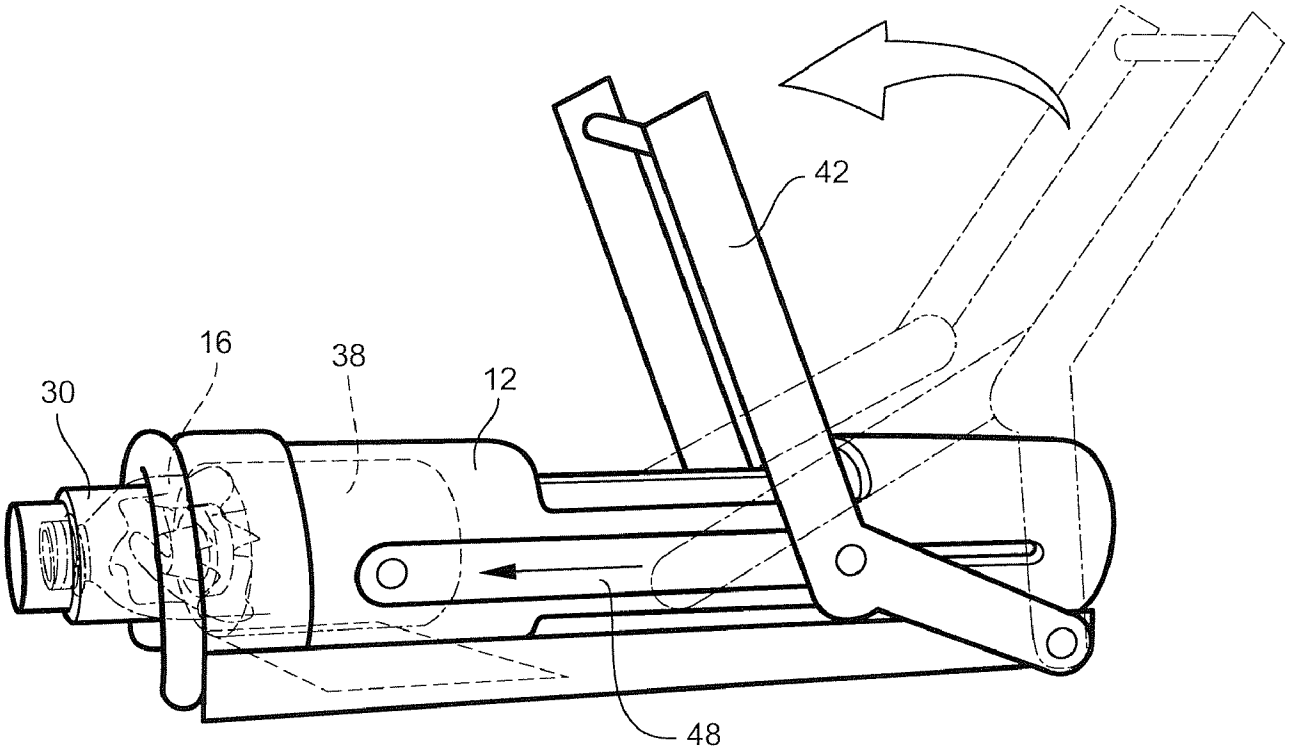
FIG. 4 is a perspective view of the compactor of FIG. 1 showing the lever fully actuated and the bottle fully compacted.
Figure 5:
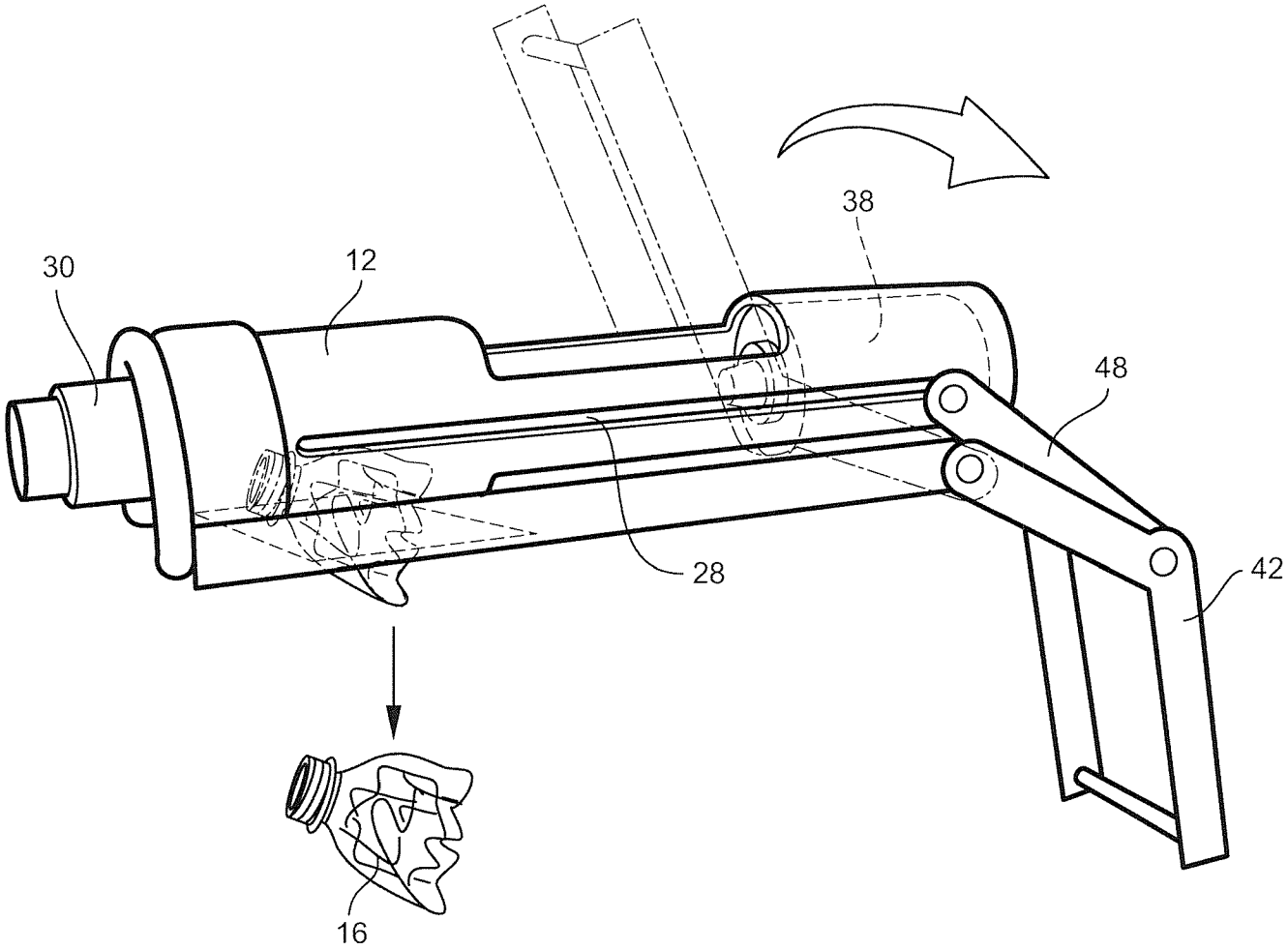
FIG. 5 is a perspective view of the compactor of FIG. 1 showing the compacted bottle falling through an opening defined through the device.

Referring specifically to FIG. 1, the compactor 10 is shown ready to be loaded with an article to be compacted, such as the PET bottle 16 shown. Referring specifically to FIG. 2, the bottle 16 is shown loaded and seated within the end cap 30, and with the piston 38 at the second end 46 of the channel 14 and apart from the end cap 30, thus with the lever 42 in the starting position. Referring specifically to FIG. 3, the lever is shown partially rotated from its starting position relative to the housing 12, thus moving the linkage 48 a predetermined distance within the guide slots 28 toward the end cap 30 and partially compacting the bottle 16. As shown, the bottle 16 is partially compacted, but not yet 'stuffed' or 'inverted'. Referring specifically to FIG. 4, the handle 42 has been rotated to its furthest compacting position, causing the linkage 48 to travel to the ends of the guide slots 28 proximate the end cap 30. As shown, the bottle 16 has been 'stuffed' or 'inverted' and is fully compacted. The lesser diameter of the ram 40 relative to that of the bottle 16, as well as the travel of the ram 40 into a portion of the protected neck end, results in the stuffing of the bottle into itself. Referring specifically to FIG. 5, the lever 42 is shown rotationally returned to its starting position, returning the piston 38 to the second end 46 of the housing 12 and allowing the compacted bottle 16 to fall from the end cap 30 through the second opening 24.

The foregoing has described a compactor for partially inverting an article to overcome the memory of the article and prevent rebound subsequent to compaction. While specific embodiments of the present invention have been described, it will be apparent to those skilled in the art that various modifications thereto can be made without departing from the spirit and scope of the invention. Accordingly, the foregoing description of the preferred embodiments of the invention and the best mode for practicing the invention are provided for the purpose of illustration only and not for the purpose of limitation.

What is claimed is:

1. A compactor device, comprising:

a housing comprising an elongate cylindrical channel therein, a sidewall, a first opening through the sidewall for providing access to the channel, and diametrically opposed elongate guide slots defined through the sidewall and along a portion of a length of the housing;

an end cap located at a first end of the housing for capping the channel and seating a neck end of a bottle therein, the cap defining a cylindrical neck end protecting portion open to the channel and having a diameter less than a diameter of the channel, the neck end protecting portion protecting a portion of the neck end of the bottle from compaction;

a piston slidably disposed within the channel and having a forward ram protrudes from a face of the piston, the ram having a diameter smaller than the diameters of the channel and the piston, and the bottle to be compacted such that the ram stuffs a bottom of the bottle into the protected portion of the neck end of the bottle as the ram is driven in the direction of the end cap; and a lever operably connected to the piston through the guide slots for actuating linear movement of the piston within the channel.

2. The compactor device according to claim 1, wherein the lever comprises a handle pivotally connected about a second end of the housing and linkage pivotally connected at a first end to the handle and connected at a second end to the piston through the guide slots, and wherein rotational movement of the handle relative to the housing is translated into linear movement of the piston within the channel through the linkage.

3. The compactor device according to claim 1, wherein linear travel of the piston within the channel and relative to the end cap is determined by at least one of a length of the guide slots and travel of the lever relative to the housing.

4. The compactor device according to claim 1, further comprising a base for securing the compactor device to a work surface.

5. The compactor device according to claim 4, wherein the handle is pivotally connected to the base at about a second end of the housing.

6. The compactor device according to claim 1, wherein the housing is cylindrical and the channel has a diameter corresponding to an outer diameter of a plastic bottle to be compacted.

7. The compactor device according to claim 1, wherein the diameter of the forward ram of the piston about corresponds to the diameter of the cylindrical neck end protecting portion of the end cap.

8. The compactor device according to claim 1, wherein the first opening has a size about corresponding to that of an uncompacted bottle.

9. The compactor device according to claim 1, further comprising a second opening having a size corresponding to that of a compacted bottle and positioned on an underside of the housing to permit a compacted bottle to fall therethrough under gravity after compaction.

10. A method for compacting a plastic bottle, comprising:

providing a compactor device comprising:

a housing having an elongate cylindrical channel therein, a sidewall, a first opening through the sidewall for providing access to the channel, and diametrically opposed elongate guide slots defined through the sidewall and along a portion of a length of the housing;

an end cap located at a first end of the housing for capping the channel and seating a neck end of a bottle therein, the cap defining a cylindrical neck end protecting portion open to the channel and having a diameter less than a diameter of the channel, the neck end protecting portion protecting a portion of the neck end of the bottle from compaction;

a piston slidably disposed within the channel and having a forward ram protrudes from a face of the piston, the ram having a diameter smaller than the diameters of the channel and the piston, and the bottle to be compacted such that the ram stuffs a bottom of the bottle into the protected portion of the neck end of the bottle as the ram is driven in the direction of the end cap; and a lever operably connected to the piston through the guide slots for actuating linear movement of the piston within the channel;

providing an uncompacted plastic bottle having an outer diameter about corresponding to the diameter of the channel and greater than the outer diameter of the ram;

inserting the uncompacted bottle into the channel through the first opening and seating a neck end of the bottle against the end cap; and actuating the lever to move the piston toward the end cap to compact the bottle, the ram stuffing a bottom of the bottle into the protected portion of the neck end of the bottle.

11. The method according to claim 10, further comprising the step of actuating the lever to move the piston toward a second end of the housing and apart from the bottle, and allowing the bottle to fall through an opening defined in an underside of the housing adjacent the cap end.

12. The method according to claim 10, wherein the lever comprises a handle pivotally connected about a second end of the housing and linkage pivotally connected at a first end to the handle and connected at a second end to the piston through the guide slots, and wherein rotational movement of the handle relative to the housing is translated into linear movement of the piston within the channel through the linkage.

13. The method according to claim 10, further comprising the step of limiting linear travel of the piston within the channel and relative to the end cap through at least one of a length of the guide slots and limiting travel of the lever relative to the housing.

14. The method according to claim 10, wherein the compactor device further comprises a base for securing the compactor device to a work surface.

15. The method according to claim 10, wherein the housing is cylindrical and the channel has a diameter corresponding to an outer diameter of a plastic bottle to be compacted.

16. The method according to claim 10, wherein the diameter of the forward ram of the piston about corresponds to the diameter of the cylindrical neck end protecting portion of the end cap.

* * * * *